US008264330B2

(12) United States Patent
Yeldell et al.

(10) Patent No.: US 8,264,330 B2
(45) Date of Patent: Sep. 11, 2012

(54) SYSTEMS AND METHOD FOR COMMUNICATING DATA IN A RAILROAD SYSTEM

(75) Inventors: Berry B. Yeldell, Lake Lotawana, MO (US); Samuel R. Mollet, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 910 days.

(21) Appl. No.: 12/349,996

(22) Filed: Jan. 7, 2009

(65) Prior Publication Data

US 2010/0171609 A1 Jul. 8, 2010

(51) Int. Cl.

| | |
|---|---|
| ***H04Q 5/22*** | (2006.01) |
| ***G08G 1/00*** | (2006.01) |
| ***G08G 1/01*** | (2006.01) |
| ***B60Q 1/00*** | (2006.01) |
| ***G05D 1/00*** | (2006.01) |
| ***B61L 23/04*** | (2006.01) |
| ***B61L 3/22*** | (2006.01) |
| ***B61L 25/02*** | (2006.01) |
| ***H04B 17/00*** | (2006.01) |

(52) U.S. Cl. .... 340/10.1; 340/901; 340/933; 340/425.5; 701/19; 701/20; 246/167 R; 246/122 R; 246/120; 246/121; 455/67.11

(58) Field of Classification Search ..... 340/901, 340/933, 425.5, 10.1; 701/19–20; 246/167 R, 246/122 R, 120–121; 455/67.11
See application file for complete search history.

(56) References Cited

U.S. PATENT DOCUMENTS

| | | | | |
|---|---|---|---|---|
| 2,064,640 | A * | 12/1936 | Bossart | 246/8 |
| 4,854,529 | A * | 8/1989 | Osada et al. | 246/187 B |
| 5,358,202 | A * | 10/1994 | Tse et al. | 246/34 R |
| 5,746,399 | A * | 5/1998 | Ehrlich et al. | 246/122 R |
| 6,122,571 | A * | 9/2000 | Gerstner et al. | 701/19 |
| 6,230,085 | B1 * | 5/2001 | Oguma et al. | 701/19 |
| 6,371,417 | B1 * | 4/2002 | Southon | 246/247 |
| 6,434,452 | B1 * | 8/2002 | Gray | 701/19 |
| 6,763,290 | B2 * | 7/2004 | Johnson | 701/19 |
| 6,830,224 | B2 * | 12/2004 | Lewin et al. | 246/167 R |
| 7,254,467 | B2 * | 8/2007 | Fries et al. | 701/19 |
| 2005/0253689 | A1 | 11/2005 | Mollet et al. | |
| 2007/0102592 | A1 | 5/2007 | Ashton | |
| 2008/0164380 | A1 | 7/2008 | Gilbertson | |
| 2009/0173842 | A1 * | 7/2009 | Lawson et al. | 246/34 R |
| 2009/0216395 | A1 * | 8/2009 | Kernwein | 701/20 |

FOREIGN PATENT DOCUMENTS

JP 2002240717 A * 8/2002

* cited by examiner

*Primary Examiner* — Daniel Wu
*Assistant Examiner* — Kam Ma
(74) *Attorney, Agent, or Firm* — GE Global Patent Operation; John A. Kramer

(57) ABSTRACT

A communications system for use in transmitting data in a railroad system is provided. The communications system includes a track circuit having a plurality of rails configured to transmit an electrical signal thereon, a first processor communicatively coupled to the track circuit via a first locomotive on said track circuit, and a trackside communications station operable to output cab signaling data, wherein the trackside communications station includes a second processor communicatively coupled to the track circuit. The first processor is programmed to compare a received data signal to a pre-stored database, and generate a response based on the comparison. The second processor is programmed to generate a corrected signal using the generated response.

18 Claims, 3 Drawing Sheets

SYSTEMS AND METHOD FOR COMMUNICATING DATA IN A RAILROAD SYSTEM

BACKGROUND OF THE INVENTION

The field of the invention relates generally to railroad systems, and more specifically, to a closed-loop cab signaling monitoring system.

Some known railroad systems use a cab signaling system that communicates track status and information to a locomotive control system from a trackside communications station, wherein the engineer or driver receives information at a display unit onboard the locomotive. Less complex systems may display the trackside signal aspect, i.e. a green, a yellow or a red light, that indicates whether it is safe to proceed, while more sophisticated systems may display speed limits, a location of nearby trains, and/or dynamic information about the track ahead. In some known systems, a speed enforcement system may overlay the cab signaling data for use in warning the driver of a dangerous condition up-track of the locomotive. Moreover, some of such systems may automatically request a braking effort to facilitate stopping the locomotive if the driver ignores or cannot respond to the dangerous condition. Such systems range from simple coded track circuits, to transponders that communicate with the cab, to communication-based train control systems.

Some known train systems experience cab signal "flips" that were the result of a loss of cab signal being decoded at the Onboard System, which then causes a resulting change to a more restrictive aspect, when, for example, the cab signal transmitted into the tracks becomes out-of-specification with respect to signal amplitude, signal period, carrier frequency and/or duty cycle. More specifically, the loss of a decoded cab signal may be due to a malfunction in the trackside communications station, an inadequately maintained trackside communications station, disruption in the track circuit itself (such as a broken rail or changing environmental conditions), a malfunction in the on-board processor, or an inadequately maintained onboard processing system. Some known systems do not include a communication link from the train back to the trackside communications station, and the inaccurate signal remains uncorrected until a maintainer adjusts or corrects the signal at the trackside communications station. Additionally, onboard systems and/or track circuits may go uncorrected as engineers and/or drivers may falsely attribute the cause of the flip to the wayside station.

BRIEF DESCRIPTION OF THE INVENTION

In one embodiment, a method of maintaining a cab signaling system is provided. The method includes correlating a data signal to a trackside communications station, transmitting the signal from the trackside communications station along a track circuit, receiving the transmitted signal by a first train, and comparing the received signal to a pre-stored database. Furthermore, the method includes generating a response based on the comparison, transmitting the response via the track circuit to at least one of the trackside communications station and at least one second train, and updating a maintenance database based on the response generated after the comparison.

In another embodiment, a communications system for use in transmitting data in a railroad system is provided. The communications system includes a track circuit having a plurality of rails configured to transmit an electrical signal thereon, a first processor communicatively coupled to the track circuit via a first locomotive on said track circuit, and a trackside communications station operable to output cab signaling data, wherein the trackside communications station includes a second processor communicatively coupled to the track circuit. The first processor is programmed to compare a received data signal to a pre-stored database, and generate a response based on the comparison. The second processor is programmed to generate a corrected signal using the generated response.

In yet another embodiment, a trackside communications station is provided. The station is operable to output cab signaling data, wherein the station includes a processor that is communicatively coupled to a track circuit and is programmed to produce a corrected signal using a generated response.

In yet another embodiment, a locomotive is provided. The locomotive is positioned on a track circuit and includes a processor communicatively coupled to the track circuit, wherein the processor is programmed to compare a received data signal to a pre-stored database, and to generate a response based on the comparison.

Various refinements exist of the features noted in relation to the above-mentioned aspects of the present invention. Additional features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

DETAILED DESCRIPTION OF THE INVENTION

The following detailed description illustrates the disclosure by way of example and not by way of limitation. The description should enable one skilled in the art to make and use the disclosure, and describes several embodiments, adaptations, variations, alternatives, and uses of the disclosure, including what is presently believed to be the best mode of carrying out the disclosure. The disclosure is described as applied to exemplary embodiments, namely, systems and methods for automatically correcting/maintaining trackside communications station output signals. However, it is contemplated that this disclosure has general application to vehicle control and detection systems in industrial, commercial, and residential applications.

Figure 1:
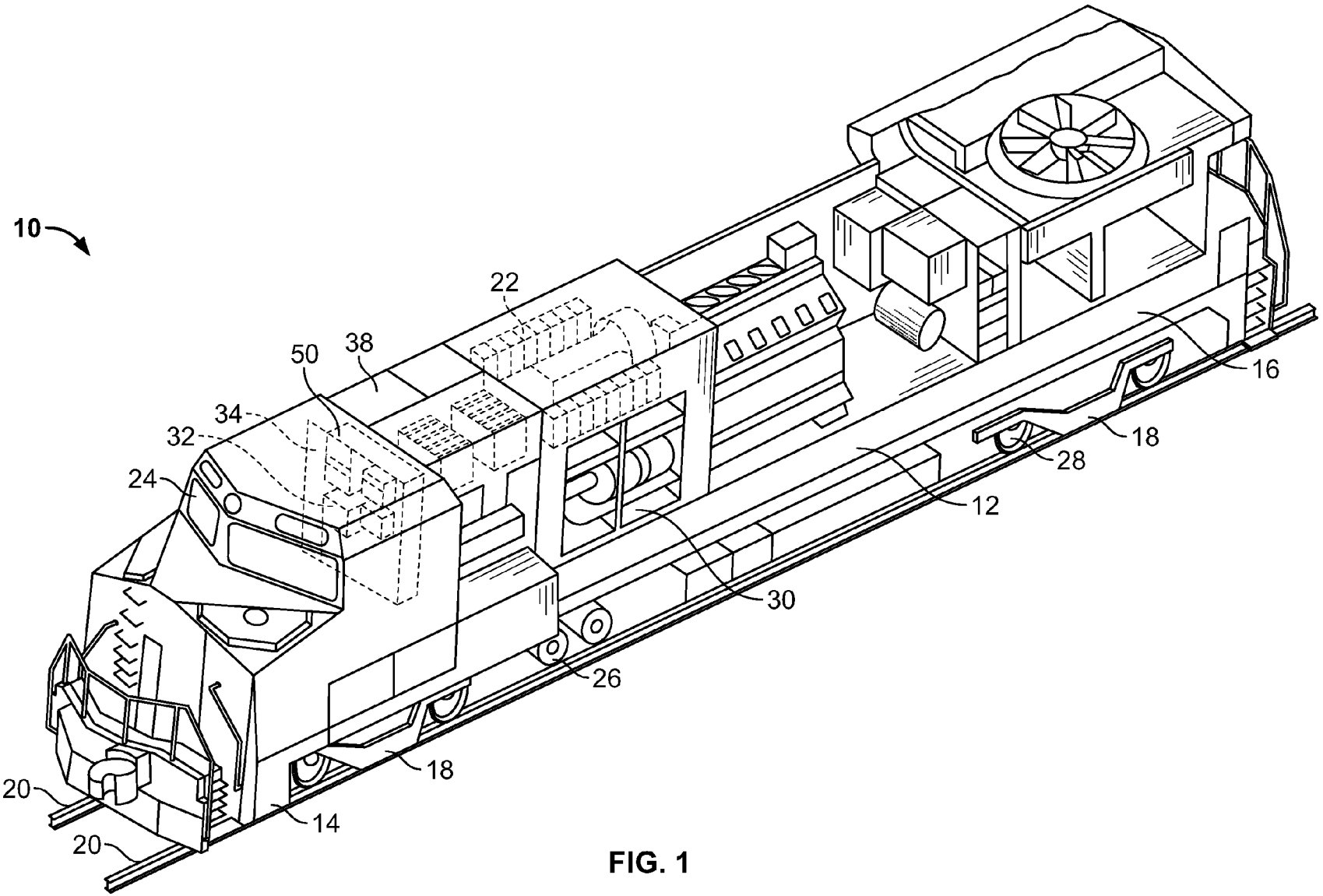
FIG. 1 is a partial cut away view of an exemplary rail vehicle.

FIG. 1 is a partial cut away view of an exemplary rail vehicle, which may also be referred to as an Off-Highway Vehicle (OHV). In the exemplary embodiment, the OHV is a locomotive 10. Locomotive 10 includes a platform 12 having a first end 14 and a second end 16. A propulsion system 18, or truck, is coupled to platform 12 for supporting, and propelling platform 12 on a pair of rails 20. An equipment compartment 22 and an operator cab 24 extend from platform 12. In the exemplary embodiment, an air brake system 26 provides compressed air to locomotive 10, which uses the compressed air to actuate a plurality of air brakes 28 on locomotive 10 and railcars (not shown) behind it. An auxiliary alternator system 30 supplies power to all auxiliary equipment and is also utilized to recharge one or more on-board power sources. An intra-consist communications system 32 collects, distributes, and displays consist data across all locomotives in a consist.

A cab signal system 34 links the wayside (not shown) to a train control system 50. In particular, system 34 receives coded signals from rails 20 through track receivers (not shown) located on the front and rear of the locomotive. As described in more detail herein, the information received provides the locomotive operator with track status information, including but not limited to speed limits, operating modes, a location of nearby trains, and/or dynamic information regarding the track ahead. A distributed power control system 38 enables remote control capability of multiple locomotives consists coupled in the locomotive 10. System 38 also provides for control of tractive power in motoring and braking, as well as air brake control.

Locomotive 10 systems are monitored and/or controlled by train control system 50. Train control system 50 generally includes at least one computer (not shown in FIG. 1) that is programmed to perform the functions described herein. The term computer, as used herein, is not limited to just those integrated circuits referred to in the art as a computer, but broadly refers to a processor, a microprocessor, a microcontroller, a programmable logic controller, an application specific integrated circuit, and another programmable circuit, and these terms are used interchangeably herein.

Figure 2:
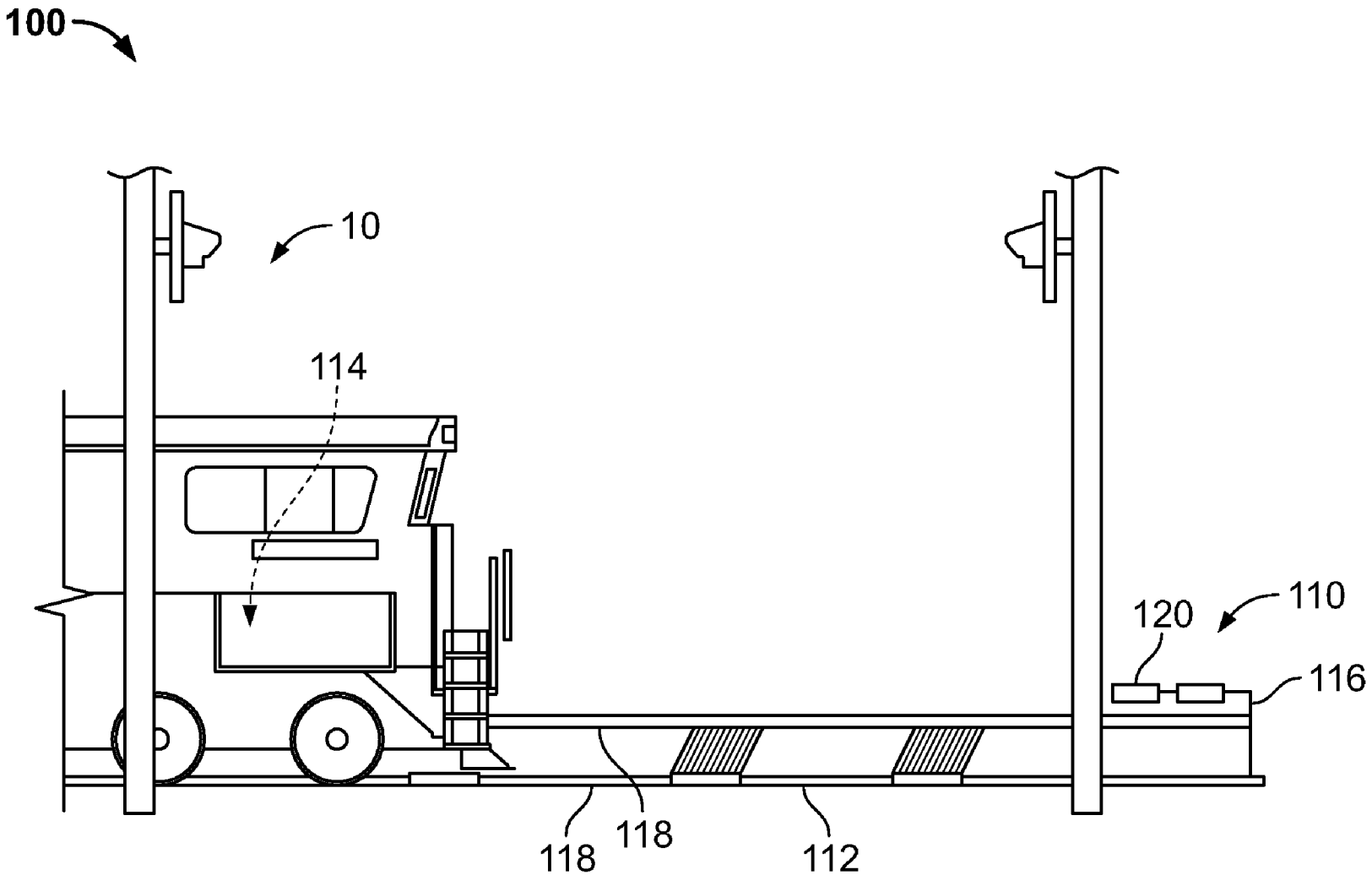
FIG. 2 is a schematic illustration of an exemplary communications system that may be used with the rail vehicle shown in FIG. 1.

FIG. 2 is a schematic illustration of an exemplary communications system 100 for use in maintaining a viable output signal for a cab signaling system 110. In the exemplary embodiment, communications system 100 includes a track circuit 112 and a trackside communications station 116 that are integrated with a locomotive control system 114. Track communications station 116 is operably coupled to track circuit 112 and enables an electric data signal (not shown) to be transmitted over a pair of rails 118 such that when locomotive 10 is in proximity of track communications station 116, locomotive 10 receives the electric data signal, as described in more detail herein. In the exemplary embodiment, track communications station 116 is a wayside that includes a processor 120 that transmits track status information across track circuit 112.

Figure 3:
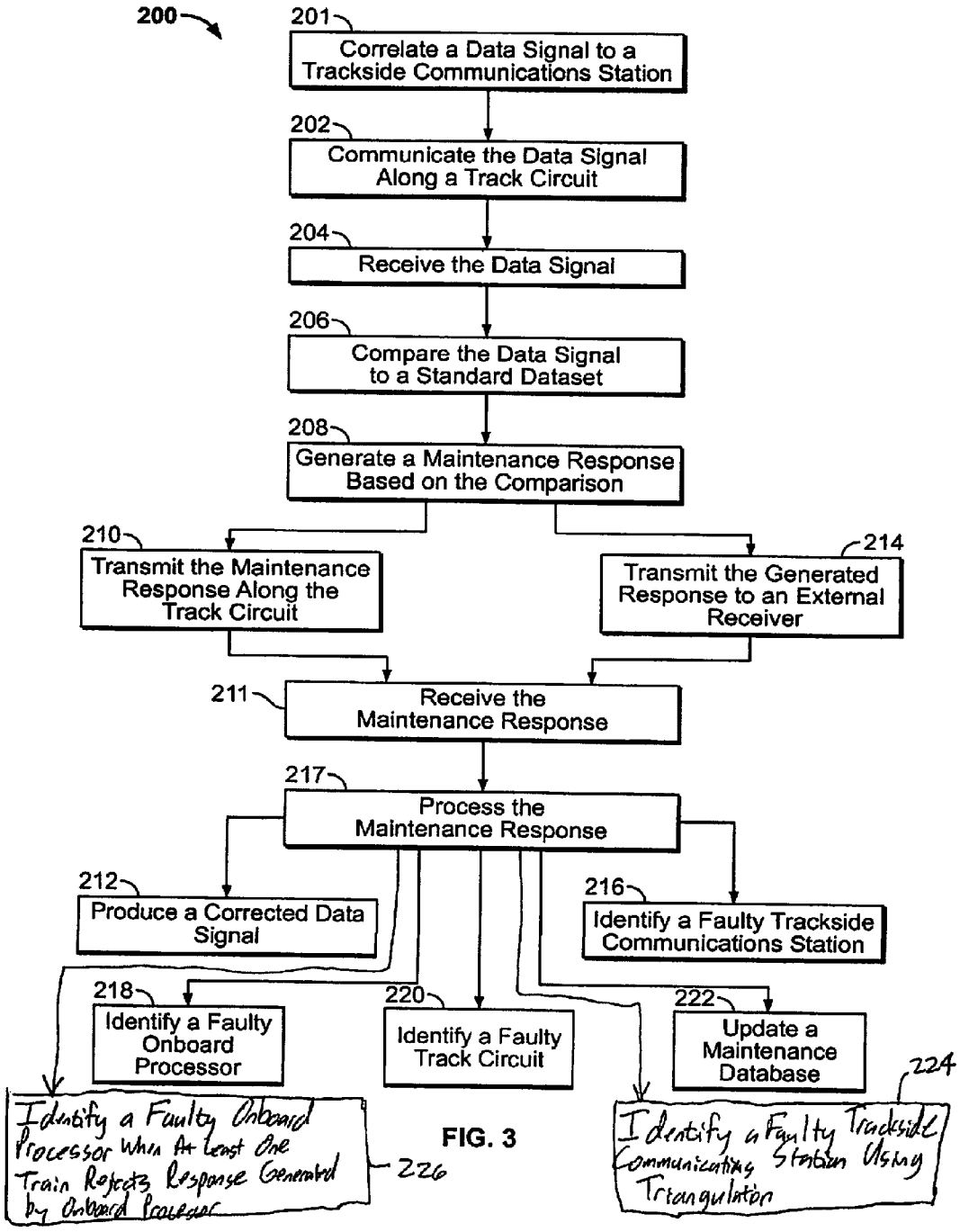
FIG. 3 is a flowchart of an exemplary method of maintaining a cab signaling system that may be used with the rail vehicle shown in FIG. 1.

FIG. 3 is a flow chart depicting a method of maintaining a cab signaling system across track circuit 112 (shown in FIG. 2), such as cab signal system 110 (shown in FIG. 2). Method 200 includes correlating 201 a data signal to a trackside communications station 116 (shown in FIG. 2). More specifically, and in the exemplary embodiment, trackside communications station 116 embeds an identifier within the data signal that will associate the data signal to that particular trackside station. Method 200 includes communicating 202 the data signal along track circuit 112. More specifically, in the exemplary embodiment, trackside communications station 116 (shown in FIG. 2), i.e. a wayside, communicates 202 track status information along track circuit 112 that is received 204 by train control system 50 (shown in FIG. 1) for use by engineers and conductors aboard locomotive. The data received 204 provides the locomotive conductor and/or engineer with information, including but not limited to speed limits, operating modes, a location of nearby trains, and/or dynamic information regarding the track ahead.

In the exemplary embodiment, information embedded within the received 204 data signal is then compared 206 to a standard dataset pre-installed within train control system 50. In the exemplary embodiment, the comparison 206 enables the quality of the data signal being communicated 202 by trackside communications station 116 to be determined. More specifically, the comparison 206 enables detection of whether the data signal is within, or is outside of, predetermined thresholds relative to signal output parameters, i.e. signal amplitude, signal period, a carrier frequency, and/or a duty cycle, for example.

In the exemplary embodiment, based on comparison 206, a maintenance response is generated 208 by train control system 50 for data signals that are outside of the predetermined thresholds. For example, if a signal amplitude exceeds operational thresholds, a response is generated 208. More specifically, train control system generates 208 a maintenance report (not shown) that instructs processor 120 (shown in FIG. 2) within trackside communications station 116 to adjust the data signal communicated along track circuit 112. This maintenance report is transmitted 210 back to trackside communications station 116 along track circuit 112 and is received 211 by trackside communications station 116 (shown in FIG. 2).

In the exemplary embodiment, following the receipt of a maintenance report by the trackside communications station 116, processor 120 adjusts and/or updates the data signal in accordance with the maintenance report generated 208 and produces 212 a corrected data signal that is based upon the maintenance response received 204 by the locomotive 10 (shown in FIG. 2). For example, an amplitude of the data signal may be reduced upon receipt of a maintenance signal from processor 120 to reduce the amplitude signal. This corrected response ensures the data signals are maintained within predetermined threshold limits and per the specification, and substantially prevents a cab "flip" as described in more detail herein.

In the exemplary embodiment, a maintenance report generated 208 may be transmitted 214 wirelessly to an external receiver and/or to a processor (not shown) and received 211 thereby. The external processor processes 217 the data and compiles a list of all received transmissions which facilitates identifying 216 a faulty trackside communications station. More specifically, and in the exemplary embodiment, any trackside communications station 116 that is communicating data that is out-of-specification, i.e. as compared to predetermined threshold limits regarding signal amplitude, signal period, a carrier frequency, and/or a duty cycle, may be reported by multiple trains receiving the out-of-specification data. As such the external processor may then identify each trackside communications station 116 producing out-of-specification data as a faulty station based upon transmissions from numerous locomotives, and in response, may initiate maintenance procedures, such as but not limited to requesting an engineer and/or maintainer to physically visit the faulty trackside communications station, e.g. trackside communications station 116, to perform a diagnosis and/or maintenance thereto. As another example, at step 224 a faulty trackside communications station is located using triangulation. Alternatively, a report generated 208 may not be transmitted wirelessly and all functions performed within communications system 100 may be transmitted externally via hardwire, or stored within communications system 100 such that cab signaling system 110 will function as described herein.

In the exemplary embodiment, a processor compiles a listing or database of all transmissions received 211 that facilitate the identification 218 of a faulty train control system 50. More specifically, a locomotive 10 may erroneously generate 208 a maintenance report in response to data received 211 by trackside communications station 116. Such erroneous responses are recorded and time-date stamped by the processor, prior to being compared against reports received from other locomotives. In the exemplary embodiment, the processor uses the recorded data to identify any locomotive 10 that is continually transmitting out-of-specification data, and identify such locomotives 10 as using a faulty train control system 50 based on the numerous erroneous maintenance reports transmitted 210 as compared to other locomotives 10 along the same track circuit 112. As another example, at step 226, a faulty onboard processor is identified when at least one train rejects the transmitted response generated by the faulty onboard processor. The processor may then initiate maintenance procedures, such as but not limited to requesting an engineer and/or maintainer calibrate, repair and/or adjust that locomotive's train control system 50. Alternatively, a report generated 208 may not be transmitted wirelessly and all functions performed within communications system 100 may be transmitted externally via hardwire, or stored within communications system 100 such that cab signaling system 110 will function as described herein.

In the exemplary embodiment, method 200 includes updating 222 a maintenance database based on the response generated 208 following the comparison 206. More specifically, and in the exemplary embodiment, the maintenance database compiles the maintenance reports that are substantially continually being updated as locomotives communicate 210 and/or 214 the data signals and comparison reports externally to the trackside communications station or to the externally-located processor. In the exemplary embodiment, the maintenance database is located at the trackside communications station. Alternatively, the maintenance database is located at any location that enables cab signaling system 110 to function as described herein, such as, for example an externally-located central processing office.

Exemplary embodiments of cab signaling systems are described in detail above. Such cab signaling systems facilitate correcting and maintaining trackside communications stations, as well as onboard train control systems. More specifically, the closed-loop cab signaling systems described herein ensure quality data transmissions by enabling a trackside communications station to self-correct itself based on feedback generated by nearby locomotives. As a result, flips within the locomotives' onboard control system are facilitated being reduced, such that dependence on human maintainers and engineers is also reduced. Moreover, maintenance and response times on such control systems are facilitated to be reduced. Also, the systems described herein use recorded data to compare subsequent transmissions against each other to facilitate alerting railroad maintainers of failing onboard computer systems with respect to the cab signal pickup quality of all locomotives. Such a cab signaling system also reduces the impact of changing track conditions, while continually maintaining and/or increasing railroad traffic throughput by automatically correcting and maintaining trackside communications stations and further alerting engineers and maintainers of faulty onboard systems. Additionally, the systems described herein substantially reduce the burden on rail maintenance personnel, facilitating reducing repair and response times for maintainers, and thereby allowing the maintenance personnel to focus resources elsewhere.

As will be appreciated by one skilled in the art and based on the foregoing specification, the above-described embodiments of the invention may be implemented using computer programming or engineering techniques including computer software, firmware, hardware or any combination or subset thereof, wherein the technical effect is to facilitate automatically correcting and maintaining trackside communications stations, as well as onboard train control systems. Any such program, having computer-readable code means, may be embodied or provided within one or more computer-readable media, thereby making a computer program product, i.e., an article of manufacture, according to the discussed embodiments of the invention. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method comprising:

correlating a data signal to a trackside communications station;

transmitting the data signal from the trackside communications station along a track circuit;

receiving the transmitted signal by a first rail vehicle;

comparing the received signal to a pre-stored database;

generating a response based on a comparison of the received signal to the pre-stored database;

transmitting the response via the track circuit to the trackside communications station; and autonomously adjusting the data signal using the response, at a processor associated with the trackside communications station, to generate a corrected data signal.

2. A method in accordance with claim 1, further comprising transmitting the response wirelessly to an external receiver.

3. A method in accordance with claim 1, further comprising identifying a faulty trackside communications station based on the response that is transmitted.

4. A method in accordance with claim 3, wherein identifying the faulty trackside communications station further comprises locating the faulty trackside communications station using triangulation.

5. A method in accordance with claim 1, further comprising identifying a faulty processor onboard the first rail vehicle based on the comparison.

6. A method in accordance with claim 1, further comprising identifying a faulty onboard processor when at least one rail vehicle rejects the transmitted response generated by the faulty onboard processor.

7. A method in accordance with claim 1, further comprising updating an output parameter of the trackside communications station, wherein the output parameter includes at least one of a signal amplitude, a signal period, a carrier frequency, or a duty cycle.

8. A communications system comprising:

a first processor communicatively coupled to a track circuit via a first rail vehicle on said track circuit, the track circuit comprising one or more rails configured to transmit an electrical signal thereon, said first processor configured to monitor a quality of a received data signal transmitted over the track circuit, wherein said first processor, when monitoring the quality of the received data signal, is configured to:

compare the received data signal to a pre-stored database, the received data signal correlated to and received from a trackside communications station;

generate a maintenance response based on the comparison of the received data signal to the pre-stored database; and communicate the maintenance response via the first rail vehicle and the track circuit to the trackside communications system; and a second processor, the second processor associated with the trackside communications station and communicatively coupled to said track circuit, the second processor configured to receive the generated maintenance response communicated via the first rail vehicle and to autonomously adjust the received data signal to generate a corrected signal for transmission via the track circuit using the generated maintenance response.

9. A system in accordance with claim 8, wherein said second processor is further configured to transmit the corrected signal along said track circuit to at least one rail vehicle.

10. A system in accordance with claim 9, wherein said first processor is further configured to transmit the response along said track circuit to at least one second locomotive rail vehicle.

11. A system in accordance with claim 8, wherein said first processor is configured to compare a received data signal to a pre-stored database comprising at least one of a signal amplitude, a signal period, a carrier frequency, and a duty cycle.

12. A system in accordance with claim 8, further comprising a remote system coupled in electronic data communication with said communications system.

13. A system in accordance with claim 12, wherein said first rail vehicle further comprises a wireless transmitter configured to transmit the maintenance response to said remote system.

14. A trackside communications station system operable to output cab signaling data, said trackside communications station system comprising a processor communicatively coupled to a track circuit, the processor configured to generate a corrected signal using a generated response received via a first rail vehicle, wherein the generated response corresponds to a signaling data signal previously communicated from the trackside communications station system via the track circuit to the first rail vehicle, and the generated response is based on a comparison of the signaling data signal to a pre-stored database by the first rail vehicle, and wherein the processor is configured to autonomously adjust the signaling data signal previously communicated to generate the corrected signal using the generated response.

15. A trackside communications station system in accordance with claim 14, wherein said processor is configured to transmit the corrected signal along the track circuit.

16. A system comprising:

a first processor communicatively coupled to a track circuit, said first processor associated with a rail vehicle and configured to execute a process that facilitates monitoring a quality of a data signal transmitted over the track circuit to the rail vehicle, wherein said processor, when executing said process, is configured to:

receive the data signal from a trackside communication station, the data signal correlated to the trackside communication station;

compare the data signal that is received to a pre-stored database; and generate, based on the comparison, a maintenance response instructing the trackside communication station to autonomously adjust the data signal to generate a corrected signal for transmission over the track circuit using the maintenance response.

17. A system in accordance with claim 16, wherein said processor is further configured to transmit the maintenance response along the track circuit to the trackside communications station and at least one second rail vehicle.

18. A system in accordance with claim 17, wherein the pre-stored database comprises at least one of a signal amplitude, a signal period, a carrier frequency, or a duty cycle.

* * * * *